US008608248B2

(12) United States Patent
Junker et al.

(10) Patent No.: US 8,608,248 B2
(45) Date of Patent: Dec. 17, 2013

(54) METHOD FOR CONTROLLING LONGWALL OPERATIONS USING BOUNDARY LAYER RECOGNITION

(75) Inventors: Martin Junker, Rheinberg (DE); Armin Mozar, Hamm (DE)

(73) Assignee: RAG Aktiengesselschaft AG (DE)

( * ) Notice: Subject to any disclaimer, the term of this patent is extended or adjusted under 35 U.S.C. 154(b) by 226 days.

(21) Appl. No.: 12/918,474

(22) PCT Filed: Feb. 19, 2008

(86) PCT No.: PCT/EP2008/001264

§ 371 (c)(1),
(2), (4) Date: Aug. 19, 2010

(87) PCT Pub. No.: WO2009/103305

PCT Pub. Date: Aug. 27, 2009

(65) Prior Publication Data

US 2011/0001348 A1 Jan. 6, 2011

(51) Int. Cl.
*E21C 27/00* (2006.01)

(52) U.S. Cl.
USPC ..... 299/1.1

(58) Field of Classification Search
USPC ..... 299/1.05–1.9; 340/683
See application file for complete search history.

(56) References Cited

U.S. PATENT DOCUMENTS

| | | | | |
|---|---|---|---|---|
| 4,189,183 | A * | 2/1980 | Borowski | 299/1.6 |
| 4,968,098 | A * | 11/1990 | Hirsch et al. | 299/1.1 |
| 5,090,775 | A * | 2/1992 | Berger | 299/1.05 |
| 5,553,925 | A | 9/1996 | Merten et al. | |

FOREIGN PATENT DOCUMENTS

| | | | |
|---|---|---|---|
| DE | 3127702 | | 2/1983 |
| DE | 3338114 | | 5/1985 |
| DE | 3742184 | | 6/1989 |
| DE | 10354281 | | 6/2005 |
| DE | 102005005869 | | 8/2006 |
| GB | 2092207 | A * | 8/1982 |

* cited by examiner

*Primary Examiner* — Sunil Singh
(74) *Attorney, Agent, or Firm* — Becker & Stachniak PC; Robert Becker

(57) ABSTRACT

A method for controlling longwall mining operations, having a face conveyor, at least one extraction machine, and a hydraulic shield support, in underground coal mining. At least one sensor is disposed on the shield support frames for acquiring solid-borne noise data generated by the engagement of the extraction machine in coal and/or country rock. A cut of the extraction machine into the country rock is determined in a downstream computer on the basis of recorded vibration data that corresponds to the generated solid-borne noise.

9 Claims, 2 Drawing Sheets

METHOD FOR CONTROLLING LONGWALL OPERATIONS USING BOUNDARY LAYER RECOGNITION

BACKGROUND OF THE INVENTION

The instant application should be granted the priority date of Feb. 19, 2008, the filing date of the corresponding International patent application PCT/EP2008/001264.

The invention relates to a method for controlling longwall mining operations having a face conveyor, at least one extraction machine, and a hydraulic shield support in underground coal mining.

The control of longwall operations during extraction generally is concerned with the best possible exploitation of the provided machine capacities while avoiding shutdowns, an automation of the required control procedures being provided if possible, in order to avoid flawed human decisions. Approaches to automation of the control are in development and/or already in use, such as sensory boundary layer detection/control, learning step methods, recognition and control of the stepping path of the stepping shield support, automated stepping of the shield support, and automatic maintenance of a predefined set inclination of the face conveyor.

One problem in the automation of controlling a longwall mining operation is, inter alia, in so-called boundary layer recognition, i.e., the recognition of the transition between coal and country rock, connected with the establishment of whether the employed extraction machine is working beyond the extraction of the coal in the overlying stratum and/or in the footwall, i.e., in the country rock. The corresponding finding is important, on the one hand, with respect to the reduction of the caving in of rock during the extraction work, because every engagement in the horizontal of overlying stratum and footwall increases the caving in of additional rocks. Furthermore, in general an engagement of the extraction machine into the overlying stratum is also to be avoided because this provides or increases the danger of caving in from the overlying stratum, and such a caving in from the overlying stratum disturbs or makes more difficult the support work using the shield support frames following the extraction front. This also applies correspondingly for a cut into the footwall level or layer of the seam opening. On the other hand, however, it can be necessary when driving through faults or driving through saddles or troughs to perform a planned footwall cut, in order to ensure a sufficient seam opening for the passage of the longwall equipment, and in this case the monitoring of the extent of the particular footwall cut is desirable.

The invention is therefore based on the object of disclosing a method according to the features mentioned at the beginning, which allows monitoring of a cut of the extraction machine in the country rock.

SUMMARY OF THE INVENTION

The achievement of this object results, including advantageous embodiments and refinements of the invention, from the content of the claims which are appended to this description.

In its basic idea, the invention provides that at least one sensor is situated on the shield support frames for detecting solid-borne noise data generated by the engagement of the extraction machine in coal and/or country rock, and a cut of the extraction machine into the country rock is determined in a downstream computer unit on the basis of the recorded vibration data corresponding to the generated solid-borne noise.

The invention primarily makes use of the finding that upon engagement of an extraction machine in the coal, on the one hand, and in the country rock, on the other hand, a varying solid-borne noise which is expressed in vibrations transmitted in the level of country rock is generated by the extraction machine. Because the individual shield support frames are tightened at correspondingly high pressure between the overlying stratum and the footwall during the extraction work, it is possible to tap the solid-borne noise data transmitted by the overlying stratum and/or the footwall, similarly to a stethoscope, in the area of an individual shield support frame. For this purpose, it is has proven to be advantageous that the transmission of the solid-borne noise from the location of its occurrence at the engagement point of the extraction machine in the country rock up to the boom of the shield support frame is not subject to any substantial damping, so that the solid-borne noise transmitted in the form of corresponding vibrations is available for an analysis to be performed in the downstream computer unit. The reliability and precision of a boundary layer detection executed in this manner is greater the more strongly the rock properties differ from the properties of the coal seam during the extraction work.

According to one exemplary embodiment of the invention, it is provided that an inclination sensor, which is situated in the floor skid and/or the top canopy of the shield support frame and is implemented as an acceleration sensor having high sensitivity, is used for acquiring the solid-borne noise data. It is to be noted for this purpose that inclination sensors of this type are provided in shield support frames belonging to corresponding longwall equipment and also for other control reasons, for example to calculate the face opening from the inclination data of the shield support frames, so that inclination sensors of this type are typically provided and thus assume an additional task in the boundary layer recognition.

Alternatively or optionally also in the event of inadequate sensitivity of the inclination sensors, it is additionally provided according to an exemplary embodiment of the invention that at least one solid-borne noise microphone is to be used on the floor skid and/or the top canopy of the shield support frame for acquiring the solid-borne noise data or recording the vibration data.

The method according to the invention may be applied in particular upon use of a disc shearer loader as the extraction machine, because the extraction chisels which are situated distributed over the circumference of the particular discs generate corresponding solid-borne noise upon entering their cutting track and in the course of this cutting track. The frequency of the chisel entries in the material to be cut is a function of the speed of the discs, the mounting density of the discs with the extraction chisels, and the march speed of the disc shearer loader. The solid-borne noise varies with the cutting resistance, which is in turn a function of the composition of the coal or the country rock and the shape of the chip generated by the extraction chisels. If a disc also cuts country rock in addition to coal, three different vibration states may fundamentally be recognized, namely the free running of the extraction chisels, the engagement of the extraction chisels in the country rock, and the engagement of the extraction chisels in the coal. In that a recognition of its engagement state is fundamentally possible for each chisel on the basis of these vibration states, an analysis of the recorded signals is made more difficult, however, in that typically multiple chisels are simultaneously engaged with the country rock, so that the signals of multiple chisels are superimposed in such a case.

In order to take this circumstance into consideration and improve the precision of the boundary layer recognition, it is provided according to an exemplary embodiment of the invention that in the case of an extraction machine implemented as a disc shearer loader, in addition to the extraction chisels, special signal chisels which amplify the solid-borne noise occurring upon entry of the chisels into the country rock are situated on at least one disc. Both the number and also the angular distribution of the signal chisels around the disc may be designed variably. Because the particular engagement time of the signal chisels in country rock and/or coal can be determined at a known peripheral distance between the signal chisels, it is possible to calculate the depth of the engagement of the disc in the country rock in the downstream computer unit in this exemplary embodiment of the invention. It is necessary for the signal chisels to have special mechanical properties in relation to the normal extraction chisels.

According to exemplary embodiments of the invention, the signal chisels may have a somewhat enlarged cutting radius and/or a special geometry and/or may be mounted in a special chisel holder, which generates a special natural frequency upon cutting of the disc into country rock, which is overlaid in an amplifying manner on the engagement frequency of the signal chisel in the country rock.

According to one exemplary embodiment of the invention, a frequency analysis is provided for the analysis of the recorded solid-borne noise data, in order to perform the required differentiation between the extraction chisels, which are located in a large number on the disc, and the signal chisels, which are only situated in a smaller number.

It is provided according to the invention that a sensor for acquiring the location of the extraction machine in the longwall is situated on the extraction machine, so that a spatial relationship between the position of the extraction machine and the assigned shield support frame can be produced in the computer unit.

BRIEF DESCRIPTION OF THE DRAWINGS

An exemplary embodiment of the invention, which is described hereafter, is illustrated in the drawing. In the figures.

DESCRIPTION OF SPECIFIC EMBODIMENTS

Although the invention is explained hereafter on the basis of an extraction machine implemented as a disc shearer loader, the basic idea of the invention using the recognition of differing solid-borne noise data during the extraction work may also be applied to plowing or planing operations having a plow or plane used as the extraction machine.

Figure 1:
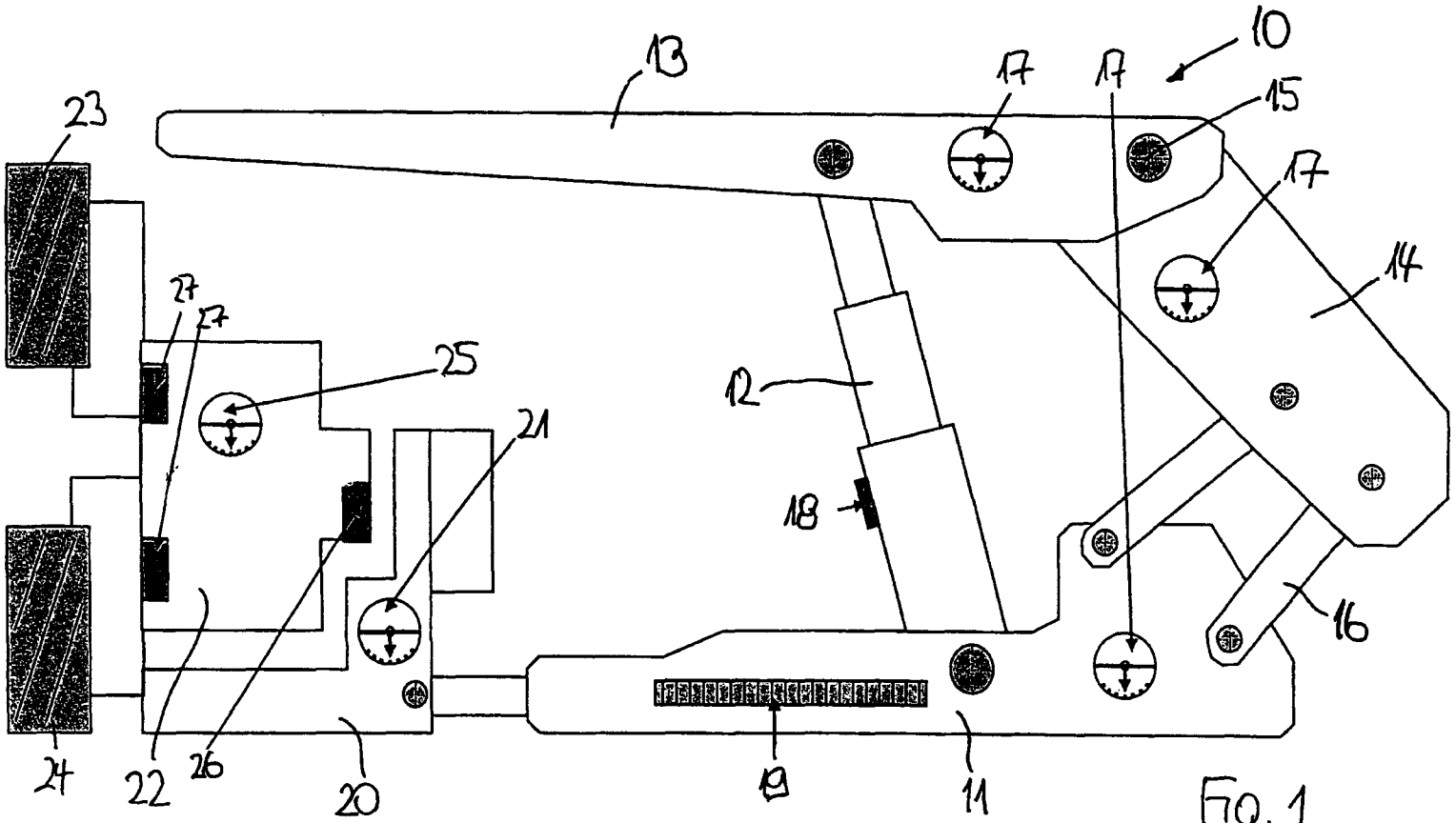
FIG. 1 shows a shield support frame having inclination sensors situated thereon in connection with a conveyor and a disc shearer loader, used as the extraction machine, in a schematic side view.

The longwall equipment shown in FIG. 1 primarily comprises a shield support frame 10 having a floor skid 11, on which two props 12 are attached in a parallel configuration, of which only one prop is recognizable in FIG. 1, which carries a top canopy 13 on its upper end. While the top canopy 13 protrudes in the direction of the extraction machine (to be described hereafter) at its front (left) end, a gob shield 14 is linked on the rear (right) end of the top canopy 13 using a joint 15, the gob shield 14 being supported by two supporting connection rods 16, which rest on the floor skid 11 in the side view. In the exemplary embodiment shown, three inclination sensors 17 are attached to the shield support frame 10, one inclination sensor 17 on the floor skid 11, one inclination sensor 17 in the rear end of the top canopy 13 in proximity to the joint 15, and one inclination sensor 17 on the gob shield 14. Of these inclination sensors, in the exemplary embodiment shown and described hereafter with respect to the method control according to the invention, the inclination sensor 17 implemented on the floor skid 11 is implemented as an acceleration sensor having such a high sensitivity that the sensitivity is suitable for recording vibrations occurring on the floor skid 11. The further inclination sensors may be used for controlling the support work in the longwall equipment shown in FIG. 1, which is decisive in a supplementary manner for the implementation of the present invention, however. This also applies for a prop pressure sensor 18 additionally provided on a prop 12 and a distance measuring unit 19 for the stepping mechanism provided in the area of the floor skid.

The shield support frame 10 shown in FIG. 1 is attached to a face conveyor 20, which also has an inclination sensor 21, so that in general data with respect to the face conveyor location may also be obtained here with respect to the control of the longwall equipment. An extraction machine in the form of a disc shearer loader 22 having an upper disc 23 and a lower disc 24 is guided on the face conveyor 20, an inclination sensor 25 also being able to be situated in the area of the disc shearer loader 22, as well as a sensor 26 for acquiring the particular location of the disc shearer loader 22 in the longwall and reed bars 27 for cut height measurement.

Figure 2:
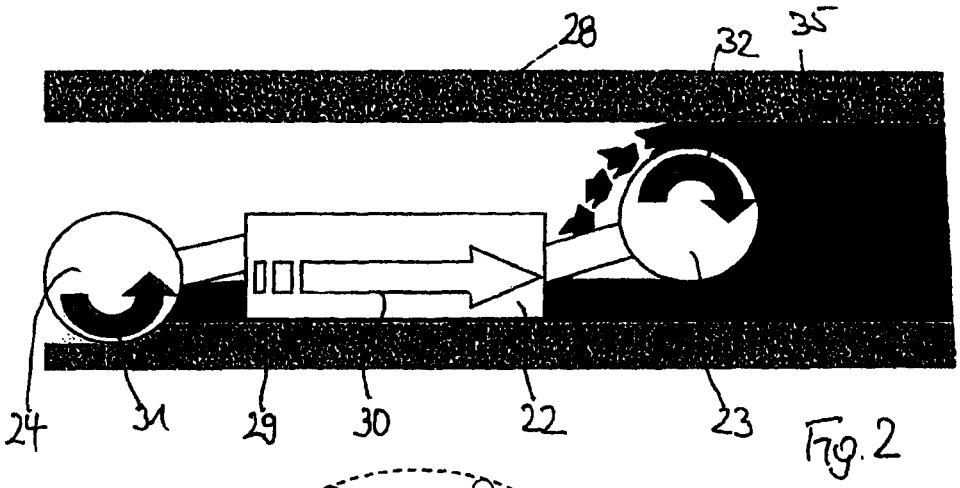
FIG. 2 shows an extraction machine according to FIG. 1 in the footwall cut in a schematic view.

The use of longwall equipment constructed in this manner with respect to the boundary layer detection during a footwall cut of the lower disc 24 is schematically shown in FIG. 2. The disc shearer loader 22 travels in the direction of the arrow 30, while the upper disc 23 cutting into the coal layer 35 at a rotational direction indicated by the arrow 32. In order to avoid a disadvantageous cut into the overlying stratum 28 of the coal layer 35, the upper disc 23 maintains a specific distance to the overlying stratum 28.

Figure 3:
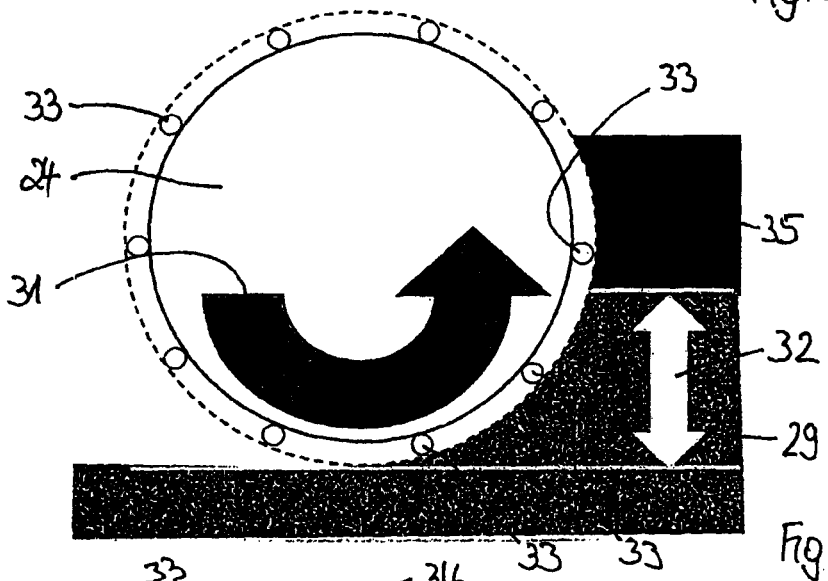
FIG. 3 shows the disc of the extraction machine in the footwall cut according to FIG. 2 in an enlarged illustration.

In the illustrated exemplary embodiment, the lower disc 24 operates in a cut in the footwall 29, the rotational direction of the lower disc 24 again being illustrated by the arrow 31. For this purpose, the mounting of the lower disc 24 with extraction chisels 33 is additionally recognizable from FIG. 3, the depth of the footwall cut being indicated by 32. It is recognizable that in the illustrated exemplary embodiment, two extraction chisels 33 are simultaneously cutting the footwall, while one extraction chisel 33 cuts into the coal layer 35 and the remaining extraction chisels 33 are not in material engagement, but rather rotate freely. Differing vibrations which are defined by the solid-borne noise generated by the engagement of the extraction chisels 33 result from this configuration, which are transmitted in the footwall 29, so that these vibrations may be recorded by the inclination sensor 17 situated in the floor skid 11 of the shield support frame 12 and analyzed in the downstream computer unit.

Figure 4:
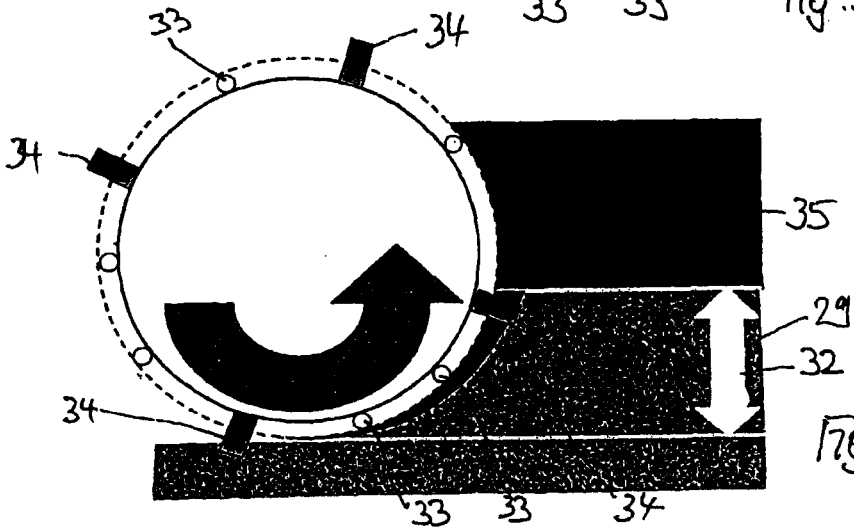
FIG. 4 shows an embodiment of the disc according to FIG. 3 having additional signal chisels situated thereon.

If it is not possible, because of the superposition of the solid-borne noise vibration signals during the simultaneous engagement of two extraction chisels 33 in the footwall 29, to calculate the depth 32 of the footwall cut, it is provided in the exemplary embodiment shown in FIG. 4 that four signal chisels 34 are situated distributed at a distance of 90° to one another around the circumference on the lower disc 24. These signal chisels 34 have special mechanical properties in relation to the normal extraction chisels 33, such as a somewhat enlarged cutting radius, a special chisel geometry, or a special chisel holder, which generates a special natural frequency upon cutting of the signal chisel into country rock. As may be seen in the illustrated exemplary embodiment, one signal chisel 34 is still fully engaged with the footwall 29, while the following signal chisel 34 has just begun its cutting movement into the footwall 29 corresponding to the engagement specified by the march speed of the disc. Therefore, only a simple signal sequence exists for the engagement cycle of the signal chisels 34, having the free running of the signal chisel, the cut into the country rock, and the cut into coal; therefore, knowing the speed of the disc 24 and the length of the cutting phase of the individual signal chisels, it can be identified over which period of time the signal chisels are cutting in engagement with the footwall 29 and how long they are outside the footwall cut. The depth 32 of the footwall cut can be calculated therefrom. The selectivity or discrimination achieved by the method according to the invention is thus significantly improved.

The features of the subject matter of this application disclosed in the above description, the claims, the abstract, and the drawing may be essential both individually and also in arbitrary combinations with one another for the implementation of the invention in its various embodiments.

The specification incorporates by reference the disclosure of International application PCT/EP2008/001264, filed Feb. 19, 2008.

The present invention is, of course, in no way restricted to the specific disclosure of the specification and drawings, but also encompasses any modifications within the scope of the appended claims.

The invention claimed is:

1. A method for controlling a longwall mining operation in underground coal mining, including the steps of:

providing a face conveyor;

providing at least one extraction machine;

providing a hydraulic shield support frame;

providing at least one sensor on said shield support frame;

acquiring, with said at least one sensor, vibration data that corresponds to solid-borne noise generated by an engagement of said at least one extraction machine in coal and/or country rock, wherein said vibration data is transmitted in a country rock layer from a point of engagement of said at least one extraction machine until said shield support frame rests against the country rock;

providing a downstream computer; and determining, in said downstream computer, a cut of said at least one extraction machine into the country rock on the basis of said acquired vibration data.

2. A method according to claim 1, wherein said shield support frame includes a floor skid and a top canopy, and wherein an inclination sensor, which is embodied as an acceleration sensor having high sensitivity, is used as said at least one sensor for acquiring the solid-borne noise data and is disposed in at least one of said floor skid and said top canopy.

3. A method according to claim 1, wherein said shield support frame includes a floor skid and a top canopy, and wherein a solid-borne noise microphone is used as said at least one sensor for acquiring the solid-borne noise data and is disposed on at least one of said floor skid and said top canopy.

4. A method according to claim 1, wherein said at least one extraction machine is in the form of a disc shear loader having two discs, further wherein at least one of said discs is provided with extraction chisels, and in addition thereto special signal chisels that amplify the solid-borne noise that occurs upon entry of said chisels into the country rock, further wherein an engagement time of individual ones of said signal chisels into the country rock is acquired, and wherein a depth of engagement of said discs into said country rock is calculated in the downstream computer from said acquired engagement time.

5. A method according to claim 4, wherein said signal chisels have an enlarged cutting radius.

6. A method according to claim 4, wherein said signal chisels have a chisel geometry that differs from that of said extraction chisels.

7. A method according to claim 4, wherein said signal chisels are mounted in special chisel holders that, upon engagement of said signal chisels into the country rock, have a natural frequency that amplifies the solid-borne noise of said signal chisels.

8. A method according to claim 1, wherein a frequency analyzer is provided to analyze recorded solid-borne noise data.

9. A method according to claim 1, which includes the step of disposing on said at least one extraction machine a further sensor for acquiring a location of said at least one extraction machine in the longwall.

* * * * *